US007588347B1

(12) United States Patent
Edwards, Jr.

(10) Patent No.: US 7,588,347 B1
(45) Date of Patent: Sep. 15, 2009

(54) LIGHTING FIXTURE

(75) Inventor: Richard D. Edwards, Jr., Westerly, RI (US)

(73) Assignee: GreenDot Technologies, LLC, Ashaway, RI (US)

( * ) Notice: Subject to any disclaimer, the term of this patent is extended or adjusted under 35 U.S.C. 154(b) by 0 days.

(21) Appl. No.: 12/103,595

(22) Filed: Apr. 15, 2008

(51) Int. Cl.
*F21V 7/00* (2006.01)

(52) U.S. Cl. ..... 362/225; 362/260; 362/346

(58) Field of Classification Search ..... 362/147, 362/223, 225, 260, 267, 297, 298, 346, 404, 362/432
See application file for complete search history.

(56) References Cited

U.S. PATENT DOCUMENTS

| | | | | |
|---|---|---|---|---|
| 2,334,005 | A * | 11/1943 | Hoeveler | 362/223 |
| 4,517,631 | A * | 5/1985 | Mullins | 362/346 |
| 2004/0218393 | A1 * | 11/2004 | Brondt et al. | 362/225 |

* cited by examiner

*Primary Examiner*—Y My Quach Lee
(74) *Attorney, Agent, or Firm*—William A. Loginov; Loginov & Associates, PLLC

(57) ABSTRACT

This invention provides a lighting fixture for use in low-ceiling applications and/or outdoor environments, such as parking garages that allows for the use of more-efficient lighting sources, such as fluorescent lamps, with more-even distribution of light along the sides of the fixture so that the surrounding space is fully and efficiently illuminated. Two elongated light sources are mounted upon opposing sides, and surrounded by a pair of respective side reflectors. The side reflectors direct the light of the two light sources in a generally sideward and somewhat-downward direction. The lower portion of the side reflectors collectively define an overall wide angle and each lower portion completely overlies a respective one of the side light sources mounted above. A third light source can be located centrally, beneath the lower portions to provide downward light, which is further reflected generally downwardly by the wide angled lower portions. Alternatively, each of the lower reflector portions can include a set of elongated slots near the center of the fixture, allowing light to pass into the lower area of the reflector in a generally downward direction. A central angled reflector can further divide and reflect the light passed through the two sets of slots. The reflectors and light sources are mounted on the internal box of a housing constructed from metal, polymer, composite, and the like. A transparent/translucent cover is removably sealed to the housing, using an intervening perimeter gasket.

20 Claims, 12 Drawing Sheets

LIGHTING FIXTURE

FIELD OF THE INVENTION

This invention relates to lighting fixtures for commercial and industrial applications and more particularly to high-energy-efficiency lighting fixtures.

BACKGROUND OF THE INVENTION

In view of ever-growing energy conservation and environmental concerns, fluorescent lighting fixtures are becoming the first choice for many commercial and residential lighting applications. In many commercial lighting applications where a long-life, high-output light is desired the choice is often a fixture using a high-intensity-discharge (HID), metal halide or high-pressure sodium (HPS) lamp. However, such lamps tend to exhibit high glare, heat generation, unnatural shades of light, and other inefficiencies that render them a good, but not an optimal choice for lighting large commercial spaces. FIG. 1 shows an example of an HID fixture 100 mounted from a garage ceiling beam 102. This example includes a single HID lamp 104 (shown in phantom) surrounded by a metallic or sturdy plastic reflector 106. The reflector may be covered with transparent plate (not shown) to seal it or other wise protected from debris (using a grating, for example). The lamp generates a downward light as shown. In this model, a transparent annulus 110 also generates a sideways lighting effect (dashed arrows 112. This provides a fuller lighting effect in a low-ceiling environment, as described further below.

One example of a large open space requiring commercial lighting is an indoor parking garage structure. In such structures lights may be operating continuously and excess heat may be problematic in underground, enclosed parking areas. Fluorescent lights present a desirable alternative in terms of their white, broad-spectrum output, cool operation and high energy efficiency. However, fluorescent lamps may exhibit lower overall light output (measured in lumens) than comparable high-intensity commercial lamps. For example, half their light is directed opposite the intended target of illumination, requiring a reflector to return this light to the target. Fluorescent lamps are also provided in long tubes that may pose challenges in focusing and distributing their light.

In most parking garage spaces, the ceiling height may be relatively low (for example, 8-12-foot ceiling height). Thus, fixtures that throw substantial quantities of horizontally directed light are desirable so as to avoid a spotting effect. This is an advantage with high-intensity lamps, which can be directed to throw substantial light sideways, as well as downward. In addition, traditional high-intensity fixtures for outdoor and parking area-placement are weatherproof, having durable sealed covers that keep moisture, vapor and other contaminants away from their internal wiring and components. However, fluorescent fixtures are typically open to the elements-many being fitted with an unsealed diffuser cover.

It is, thus, highly desirable to provide a lighting fixture that uses fluorescent tubular lamps, or another type of elongated light source, such as an LED array/strip. This elongated lighting fixture should be particularly suitable for parking areas and other enclosed structures, and afford superior light distribution (photometrics) and overall performance. Such a fixture should be easily retrofit into existing structures and exhibit performance generally similar to other high-intensity fixture types with generally lower power consumption. This fixture should be able to provide desired output using as few as two conventional fluorescent lamps or other elongated lighting sources. It should also be mountable in a pendant manner with a sealed housing to keep out moisture and contaminants.

SUMMARY OF THE INVENTION

This invention overcomes the disadvantages of the prior art by providing a lighting fixture for use in low-ceiling applications and/or outdoor environments, such as parking garages that allows for the use of more-efficient lighting sources, such as fluorescent lamps, with more-even distribution of light along the sides of the fixture so that the surrounding space is fully and efficiently illuminated. The fixture employs two elongated light sources mounted upon opposing sides, and surrounded by a pair of respective side reflectors. The side reflectors direct the light of the two light sources in a generally sideward and somewhat-downward direction. The lower portion of the side reflectors collectively define an overall wide angle and each lower portion completely overlies a respective one of the side light sources mounted above. Thus, the lower portions generally prevent predetermined light from the side light sources from being projected in a vertical or generally downward direction. A third light source can be located centrally, beneath the lower portions to provide downward light, which is further reflected generally downwardly by the wide angled lower portions. Alternatively, where only the side light sources are employed, each of the lower reflector portions can include a set of elongated slots near the center of the fixture. The slots allow a predetermined quantity of light to pass into the lower area of the reflector, and thereby in a generally downward direction. A central angled reflector can further divide and reflect the light passed through the two sets of slots. This central reflector creates the illusion of a virtual, third, bottom light source. In each embodiment, light is efficiently directed to both the sides of the fixture and beneath it to more-fully light a low-ceiling space. In various embodiments, the reflectors and light sources are mounted on the internal box of a housing constructed from metal, polymer, composite, and the like. A transparent/translucent cover is removably sealed to the housing, using an intervening perimeter gasket that ensures a weather-tight construction.

More particularly, in an illustrative embodiment the lighting fixture includes a housing having a widthwise dimension and an elongated dimension adapted to be mounted to a supporting structure. A light-transmitting cover is secured to a lower end of the housing with a seal provided between the housing and the cover. A light source supporting structure is operatively connected to the housing and securing a first light source and a second light source so that the first light source and the second light source each extend along the elongated dimension on each of opposing widthwise sides of the housing. A reflector assembly with a cross-section shape constructed and arranged to cover each of the first light source and the second light source with upper reflector portions, lower reflector portions and central reflector portions, the upper reflector portions and lower reflector portions respectively extending in a generally widthwise direction so as to fully overlie and extend beyond a widthwise end of each of the first light source and the second light source so that the predetermined light output from each of the first light source and the second light source is directed above a generally downward direction, and further constructed and arranged to allow predetermined light output to be discretely projected in the generally downward direction.

In one illustrative embodiment the lighting fixture the lower reflector portions of the lighting enclose a third lighting source, extending in the elongated dimension, which projects light discretely in the generally downward direction. In another illustrative embodiment, the lower reflector portions each include a plurality of elongated slots therealong that respectively transmit light from the first light source and the second light source into a region of the lower reflector so that the light transmitted through the slots is directed in the generally downward direction. The slots have a length generally along the widthwise dimension of between approximately ½ and 1 inch. In this two-lamp embodiment, the location of the third light source is replaced with a central divider reflector with a pair of downwardly extending reflector walls defining a cross section extending from spaced-apart locations at the lower reflector portions, adjacent to edges of the slots, to a bottommost convergence line. In either embodiment, the light sources can comprise tubular fluorescent lamps, a plurality of lamps or solid state arrays, such as LED arrays.

BRIEF DESCRIPTION OF THE DRAWINGS

The invention description below refers to the accompanying drawings, of which.

DETAILED DESCRIPTION

Figure 1:
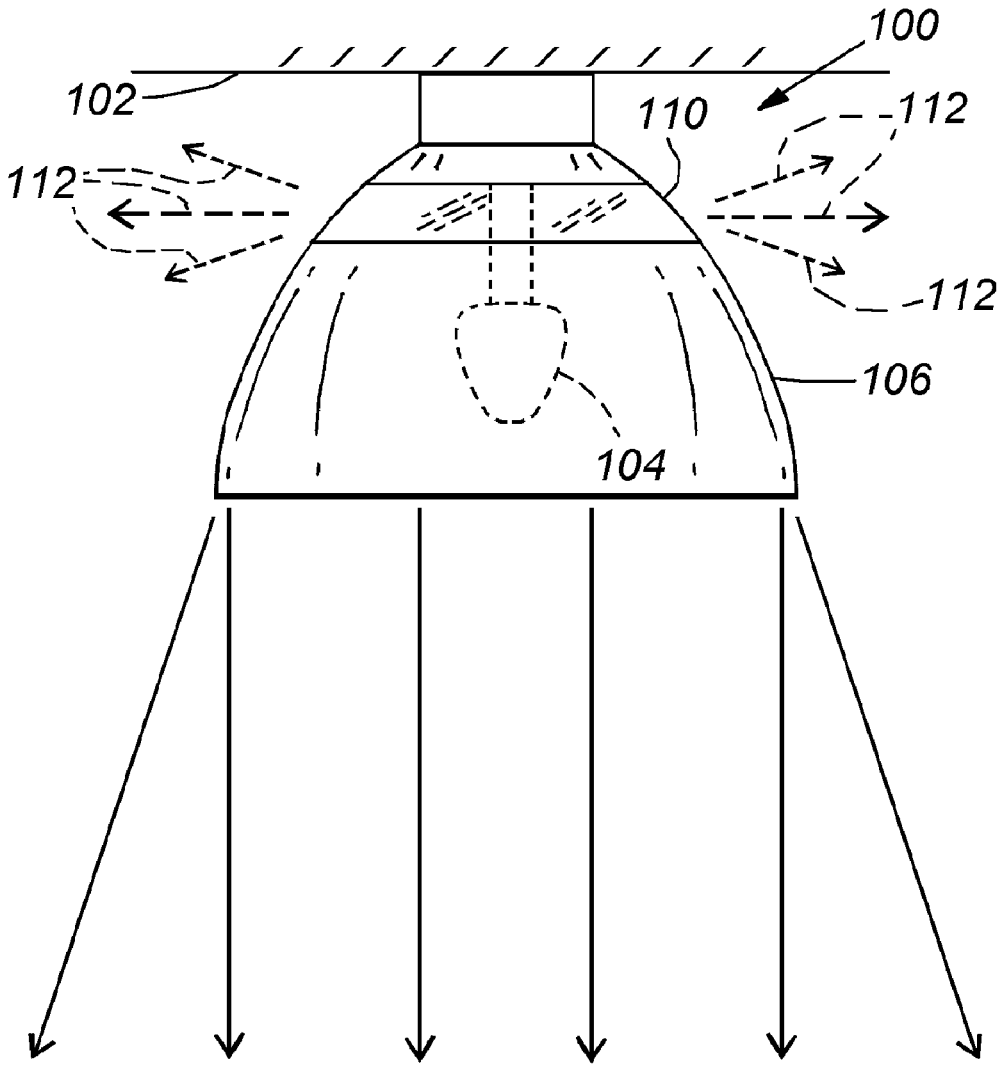
Fig. 1 (Prior Art)
FIG. 1 is, already described, is a side view of a conventional high-intensity discharge (HID) lighting fixture for use in parking garages and other generally out door areas.
Figure 2:
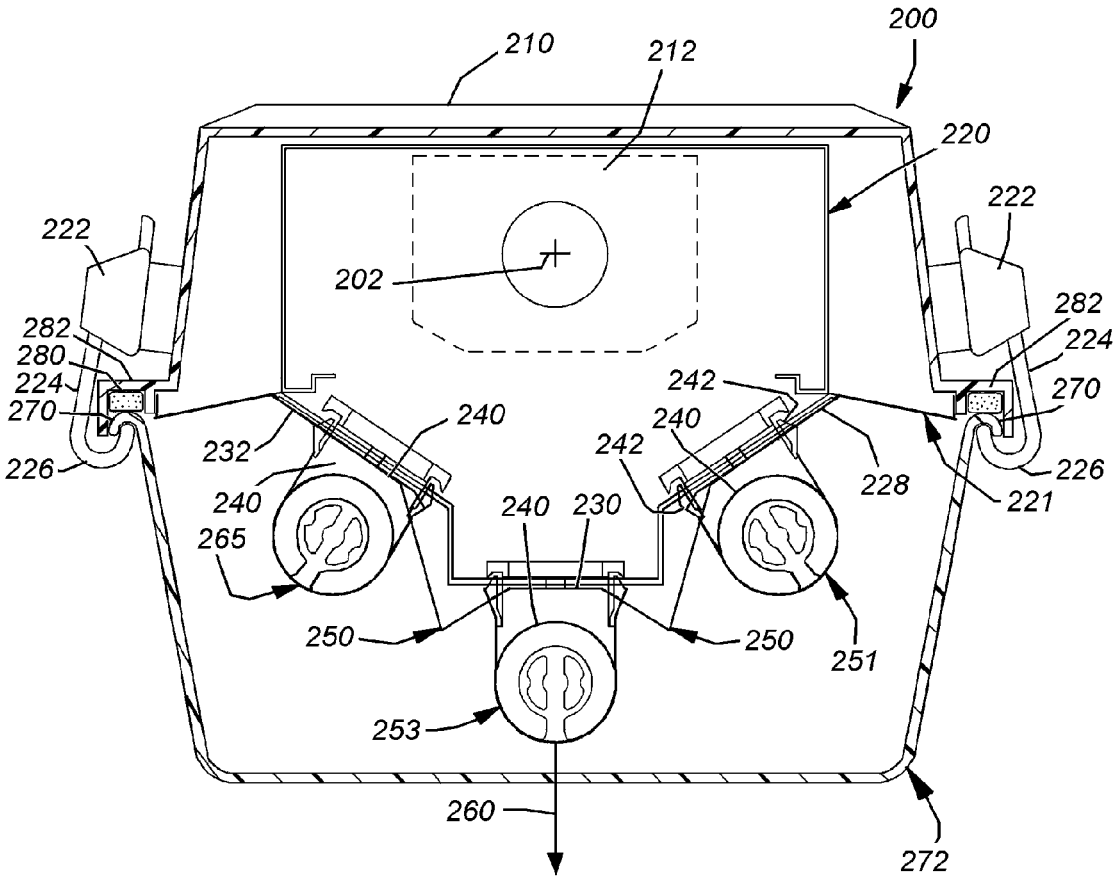
Fig. 2 (Background Art)
FIG. 2 is a side cross section of a three-lamp sealed florescent lighting fixture for use in parking garages and other outdoor environments according to a prior implementation.

By way of further background, FIG. 2 details a cross-sectional view of a fluorescent lighting fixture 200 (also commonly referred to in industry as a "luminaire") for use in low-mounting height applications, such as parking garages and other environments requiring weather and debris-resistance, according to a prior implementation. The fixture 200 can be at least three-feet in length, taken in the longitudinal or elongated direction, perpendicular to the page of the drawing (and indicated by the longitudinal axis 202). Its width is between approximately six and 12 inches. In general it is wider enough to effectively mount, and spread the light of the three depicted lamps (251, 253 and 255) in an arc of approximately 180 degrees about the axis 202. The fixture 200 includes an upper housing 210 that encloses a fluorescent light ballast 212 of any appropriate design. The housing can be constructed from durable polymer (as shown), metal or another suitable material (for example glass-filled nylon, fiberglass or a composite). The housing 210 encloses, within its interior a sheet metal (or other material) box enclosure 220. The box 220 acts as a sub-enclosure for the ballast 212, and its lower end defines a support for a reflector structure 221. The reflector structure 221 is secured to the box 220 by clips, fasteners or another attachment mechanism. The box 220 is, likewise, attached to the interior surface of the upper housing 210 by fasteners or other acceptable attachment mechanisms.

The exterior side walls of the housing 210 includes raised base structures 222 that can be integrally molded with the housing 210, or can be provided as separate pieces that are secured to the housing 210 by fasteners. The raised structures 222 support spring-steel connectors 224 that extend downwardly to an inward curve 226. The reflector structure 221 includes a pair of opposing mounting bases on each longitudinal end of the fixture that define respective flats 228, 230 and 232, oriented at various angles. Conventional fluorescent lamp bases 240 are mounted on each of these flats. The lamp bases 240 can be secured by a number of different techniques. As shown, they are locked in place by unitary spring-loaded shoulders 242 that engage the side edges of a properly sized recess (i.e. a rectangular through-hole) in each flat 228, 230, and 232. While not shown, appropriate wiring can be provided between the ballast 212 and the bases 240, as well as between the ballast 212 and an external source of electric power. The reflector structure 221 extends between opposing mounting bases on the fixture 200 and provides a series of angled facets that reflect the light of each lamp in the appropriate direction. In general, the facets of the reflector structure 221 are designed to direct the projected light of the two side lamps 251 and 255 generally in a sideways direction. The facets direct the light of the bottom lamp 253, generally in a downward direction. As will be discussed below, the illustrative embodiments of the invention provide structures that more effectively divide the light of three or two lamps than the arrangement of the prior implementation of FIG. 2. As also shown, the reflector structure defines a pair of angled projections or pinnacles 250 that extend the full length of the base in the elongated/longitudinal direction (elongated axis 202). These pinnacles 250, along with a reflective light or specula surface finish on the reflector structure 221 allows for reflection of light in a plurality of direction. However, in general, most light in this example is directed downwardly because at least fifty percent of each lamp's overall diameter facing directly down (vertical arrow 260).

Note, as used herein, directional terms, such as "top", "bottom", "upper", "lower", "sideward/sideways", "vertical", and "horizontal" should be consider as relative conventions, and not to limit the mounting orientation or structure of any described fixture.

To seal the light fixture 200 against encroachment by moisture, debris, pollutants and other environmental hazards, the clips 224, and their rounded-over end segments 226 engage a lip 270 formed along each side of a transparent or translucent light cover 272. The light cover 272 can be faceted or frosted to allow a more-diffuse transmission of light from the lamps 251, 253, 255, or it can be relatively clear. It is constructed from glass, durable polymer or another material that allows transmission of light therethrough. When engaged as shown, the spring clips 224 bias the lip 270 against an elastomeric gasket 280 that is seated between the lip 270 and a recess 282 in the housing 210. The gasket 270 maintains a moisture-tight seal between the housing 210 and the transparent/translucent cover 272. In this manner, the fixture 200 of FIG. 2 is weatherproof, making it appropriate for indoor parking garages and other applications in which are exposed to moisture, exhaust, salt, thrown-objects and other hazards.

As also discussed above, a disadvantage of this fixture 200 is that at least fifty percent of the cylindrical surface of each fluorescent lamp 251, 253, 255 is directed vertically downward. The underlying reflector structure 221 attempts reflect the remaining light, but the general direction of light is still essentially downward for each lamp. In low-ceiling applications, such as parking garages, it is desirable to spread light in a more horizontal/lateral/sideward fashion so that a single fixture can cover a larger area. This reduces the number of fixtures required, maximizes their individual efficiency, and therefore, reduces operating costs.

Figure 3:
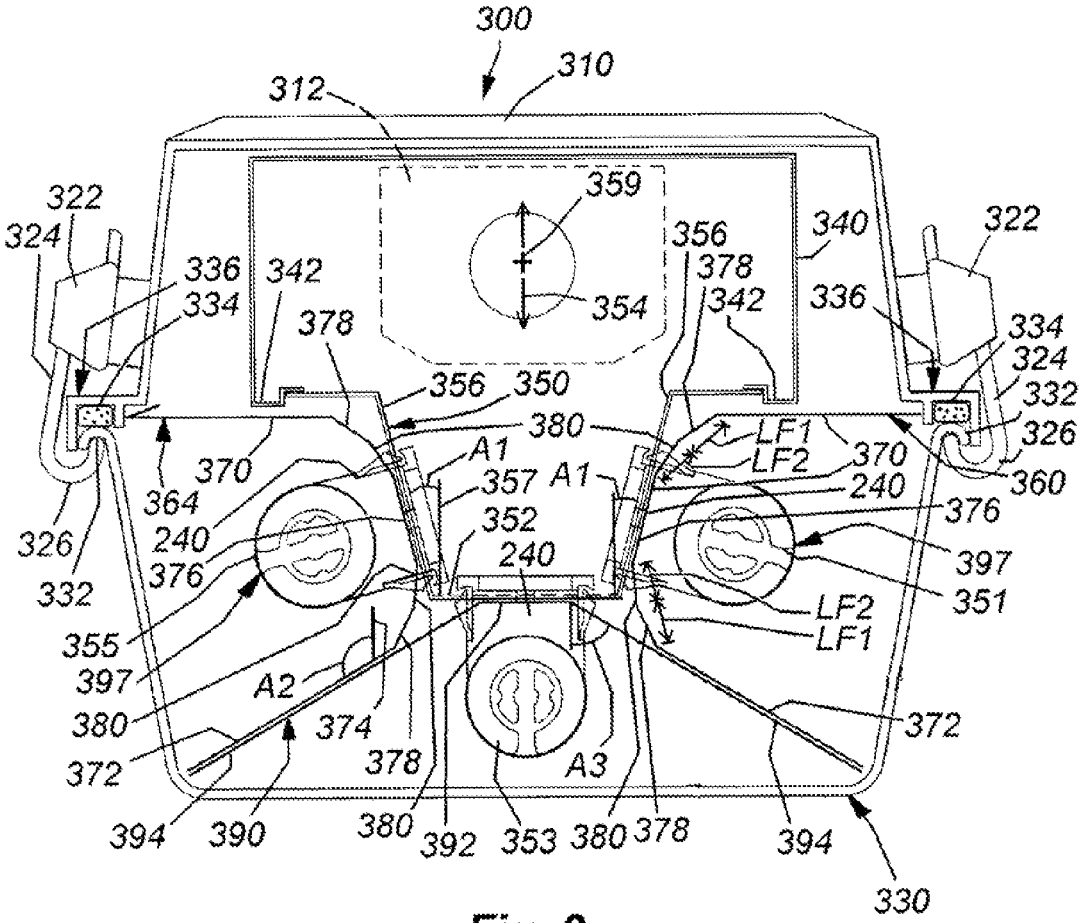
FIG. 3 is a side cross section of a three-lamp lighting fixture for use in garages and other weather-exposed environments according to an illustrative embodiment of this invention.

Accordingly, a three-lamp fixture 300 according to an illustrative embodiment is shown in FIG. 3. In this embodiment, the housing 310 is essentially similar to that (housing 210) of the fixture 200 described above. It includes a ballast 312, spring clip supports 322 and associated spring clips 324. The spring clips 324 curve inwardly at lower curved end segments 326 to secure a transparent or translucent light cover 330. The cover can be clear, frosted or textured (so as to diffuse the light) as appropriate to the lighting application. The cover 330 includes a lip 332 that surrounds its perimeter. The lip 332 secures against an elastomeric gasket 334, which itself, resides within a base 336 formed on the bottom lip of the housing 310.

Figure 5:
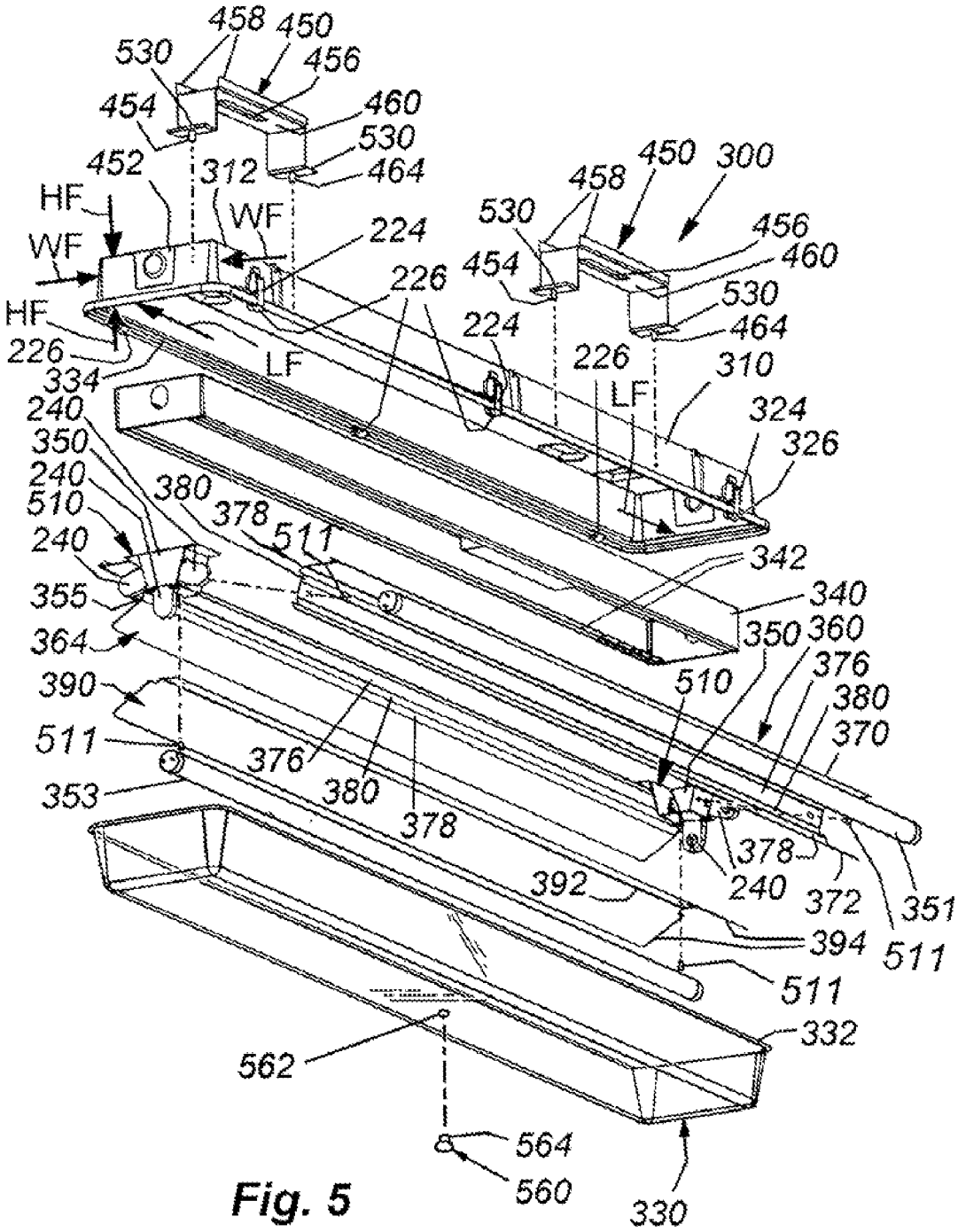
FIG. 5 is an exploded perspective view of the three-lamp fixture of FIG. 3.
Figure 6:
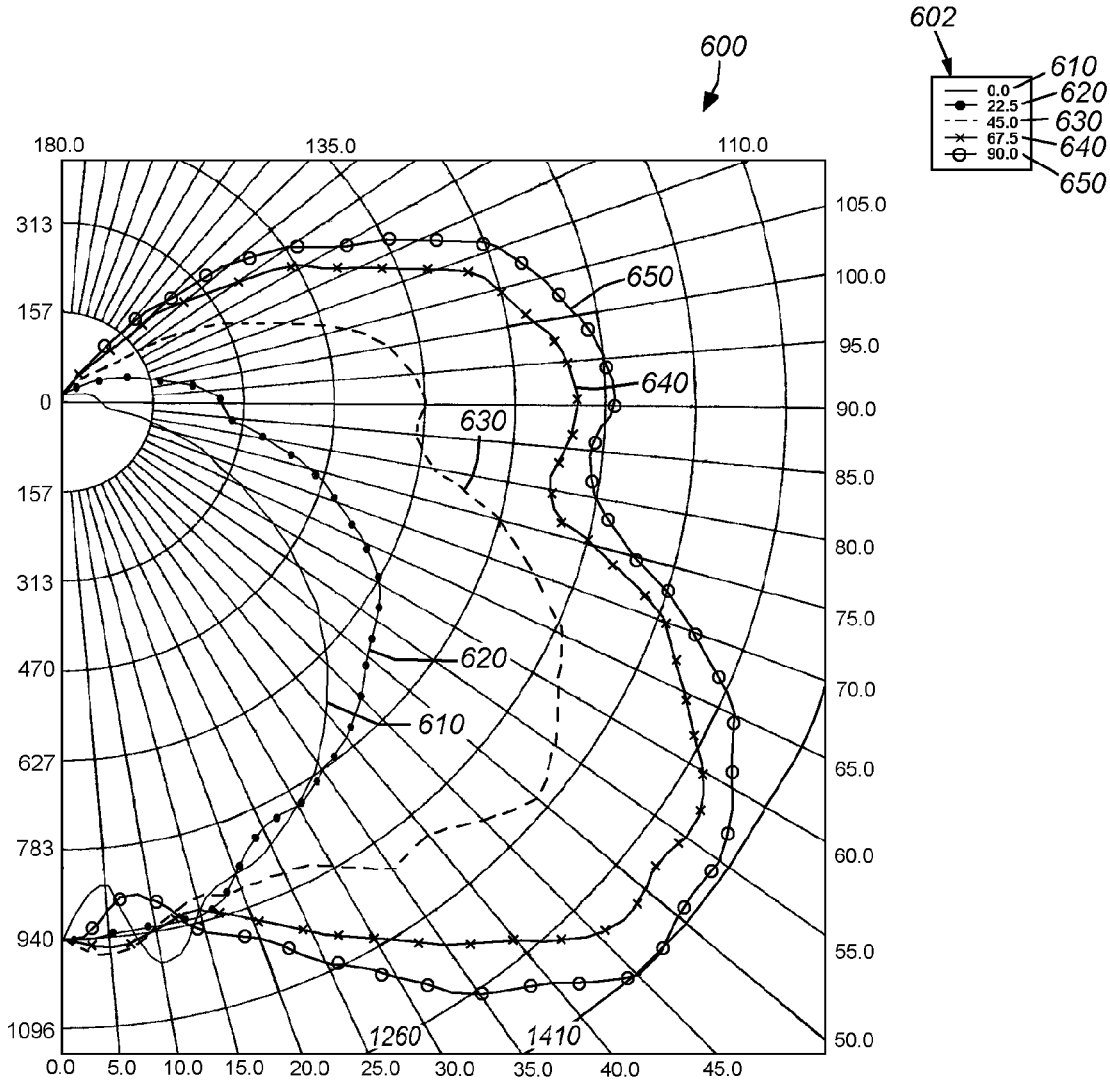
FIG. 6 is a polar-coordinate graph of the light distribution at various viewing angles for the three-light fixture of FIG. 3.

With further reference to FIGS. 5 and 6, the structure of the fixture 300 is shown and described in further detail. In general, the illustrative fixture 300 has an overall width WF of approximately 6 to 7 inches and an elongated length LF of approximately 48-49 inches and an overall housing height HF of between approximately 3 and 5 inches. These dimensions are highly variable. Notably, the fixture's lamp ballast 312 is encased within an internal box structure 340 that can be constructed from sheet metal or another acceptable material. The box structure 340 is attached to the inner surface of the housing 310 using fasteners or any other acceptable fastening technique. The bottom edge 342 of the box structure (or simply "box") 340 supports a pair of longitudinally opposed lamp supports 510 (FIG. 5), each defining a central base 350 that extends further downwardly, and divides the fixture's lower end into three separate sections. Each support 510 is attached to an opposing end of the box 340, along the bottom edge 342. The separate lamp sections defined by each central base 350 provide support for reflectors that extend along the entire longitudinal direction, taken along elongated axis 359. The central base 350 includes a bottommost flattened section 352, which extends along a plane perpendicular to the vertical direction (arrow 354 and line 357). A pair of angled side walls 356 of each central base 350 extend upwardly from each opposing widthwise corner of the bottommost section 352. The angled sidewalls extend at an angle A1 from the vertical of between approximately 5 degrees and 20 degrees. The illustrative angle A1 is 15 degrees. The central base 350 supports each of three lamp bases 240 which connect to, and support, an end of a respective fluorescent lamp of an appropriate size, shape and wattage. In one embodiment, 48-inch-long, bi-pin-connector, T-8 lamps, with a tube diameter of 1 inch are employed in the various embodiments described herein. Other dimensions of the depicted cross-sections herein can be scaled to the diameter of the lamp. A variety of other lamp sizes, shapes, wattage ratings and connector configurations can be employed in alternate embodiments. Likewise, in alternate embodiments, fluorescent lamps can be substituted with another type of lamp having low power-consumption and high output characteristics. For example, elongated strips of LED's, arranged in arrays can be used with an appropriate power source/transformer (LED driver). This power source/driver can be located directly on the LED array circuit board, or positioned where the ballast 312 is located. Thus, as used herein the term "lamp" and/or "light source" should be taken broadly to include other types of energy-efficient lighting systems.

The central base 350 on each of the opposing lamp supports 510 carries three reflectors 360, 390 and 364. Each reflector is constructed from a relatively thin. Light weight material such as metalized aluminum, plastic or another suitable material. The reflector can be provided with a mirrored/specular finish, a gloss or matte-white-painted finish, or any other surface finish that allows a substantial quantity of light to be reflected therefrom. As shown, the reflectors 360 and 364, which extend somewhat horizontally/sideward from opposing widthwise sides of the central base 350, allow the sides of the lighted area to be effectively filled with directed light. In this description, "widthwise" is taken in a direction perpendicular to the elongated vertical 354 (perpendicular axis 520 in FIG. 4) The/upper top flat 370 of each reflector is generally perpendicular to the vertical 354. The bottom/lower flat 372 of each reflector 360, 364 extends downwardly at an angle A2 (374) (relative to the vertical 354) of approximately 110 to 130 degrees and an illustrative angle of 120 degrees. The base flat 376, which his positioned behind each respective lamp base 240 is flush against the angled sidewall 356 of the central base 350. Thus, the base flat 376 also extends at the approximate angle A1 from the vertical 354. Between the upper and lower flats 370, 372 and the central flat 376 on each reflector 360, 364, there are a pair of intermediate flats 378 and 380. Each intermediate flat 378, 380 has a respective length LF1, LF2 between but approximately one-quarter inch and three-quarter inch. The intermediate flats 378, 380 define angles (with respect to the vertical 354) that are between that of the base flat (angle A1) and the adjacent flats 370, 372 (90 degrees and angle A2). Thus, the flats 378 and 380 form an incremental bend in the over all cross section of the reflectors 360 and 364. The precise angle of each intermediate flat 378, 380 with respect to vertical 354 is highly variable. In general, they prevent the defining of a sharp between the central flat 376 and the adjacent upper and lower flats 370, 372. In this manner the reflected light from lamps 351, 355 is spread more-continuously. The side reflectors 360, 364 attach to each opposing central base 350 using fasteners (e.g. fastener 511 in FIG. 5).

Note that the number of flats employ to form each reflectors highly variable. In this embodiment, a pair of intermediate flats 378 and 380 is efficient to define a somewhat continuous transition between upper and lower flats 370, 372 and the central flat 376. In alternate embodiments, the intermediate flats 378, 380 can be substituted by a curvilinear cross sections or another acceptable shape that connects the intermediate flat 376 to the upper and lower flats 370, 372.

The lower lamp is surrounded by a widely-angled lower reflector 390. This lower reflector 390 also extends the full elongated length (axis 359) includes a central flat 392 and a pair of opposing angled flats 394. Each angled flat 394 defines an angle A3 with respect to the vertical 354. The angle A3 is between approximately fifty and 70 degrees in this embodiment. The illustrative angle is approximately sixty degrees.

The lower reflector 390 affords a relatively widespread reflection of light from the lower lamp 353. The reflectors 360, 364 and 390 in this embodiment are imperforated, fully reflective (i.e. non-translucent) units through which approximately zero light is transmitted. Thus, they reflect approximately one hundred percent of the light to which they are exposed. Moreover, the lower reflector flats 394 (and confronting side reflector flats 372) extend at least one to two inches in the widthwise direction beyond the widthwise ends 397 of the lamps 351, 355. Each reflector, thus, provides a wide range of coverage for its respective lamp, resulting in three substantially separated reflective compartments along the elongated length of the fixture 300. The fixture 300 thereby defines three discrete and controlled lamp regions (one below and two on opposing sides) that each fill their respective lighting area with an appropriate amount of light. In particular, a greater amount of light from the side lamps 351 and 355 is transmitted sideward, than by the arrangement of FIG. 2 to better fill the lit space.

Figure 4:
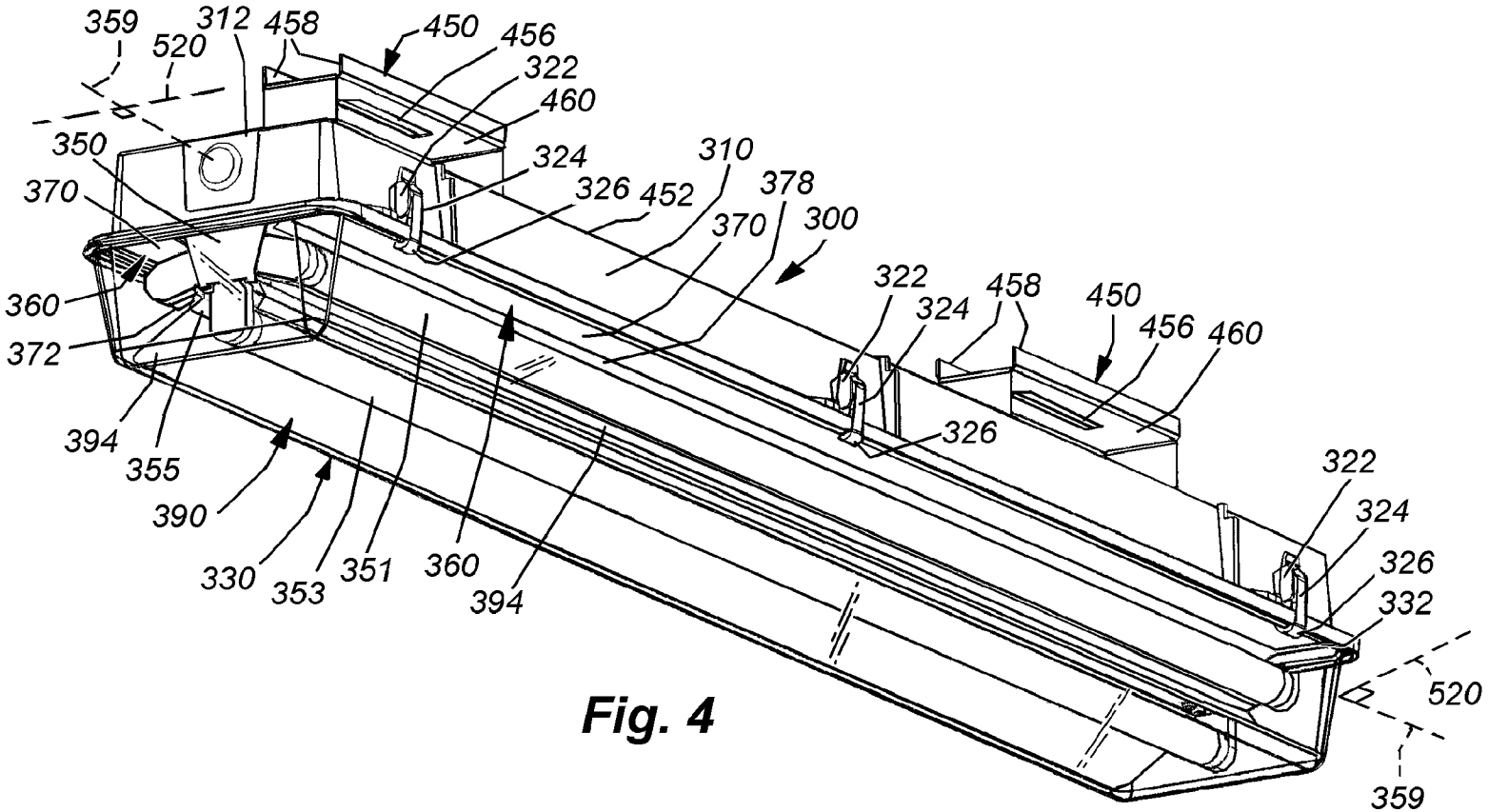
FIG. 4 is a perspective view of the three-lamp fixture of FIG. 3.

With particular reference to FIGS. 4 and 5, the housing 310 is adapted to be mounted in a manner similar to any conventional HID-type fixture. In this embodiment, a pair of reinforced brackets 450 are attached to the top surface of the housing fasteners, rivets or another acceptable mechanism (in this embodiment, bolts 454) that pass through the upper surface of the housing 310, and thereby allow the flat, generally horizontal bases 530 of the brackets 450 to be sealed against the housing. Each bracket 450 includes an elongated slot 456 on its top surface plate 460 for receiving a threaded hanger rod, or other fastening system attached to the building's ceiling or other fixture mounting surface. A pair of folded-up wings 458 is provided along the top surface 460 of each bracket 450. These wings can be any size and shape. In general, they help to reinforce the bracket 450, and prevent bending of its top surface 460 under load. The bracket 450 can be constructed from relatively thin-gauge sheet steel, or similar metal (or another material as appropriate). In general the bracket 450 of this invention, with its elongated slot 456, uniquely allows the fixture to be supported, at least in part by preexisting fixture support posts/rods. The slot also allows for variability in the fitment of the fixture with respect to new-construction, newly installed and preexisting support rods/posts so that the brackets 450 can be uniformly placed on the housings of fixtures. Alternatively, brackets can be supplied separately and custom-positioned on a housing, for example, a drill and self-tapping screws or through nuts/bolts.

The photometric performance of the light fixture 300 is shown by the polar-coordinate graph 600 of FIG. 6. The lines of the graph 600 plots sensed candela strength (in lumens) versus viewing angle between a directly downward or vertical orientation (0-degrees), a directly sideward or horizontal orientation (90 degrees), and directly upward orientation (180 degrees above the fixture). The overall candela strength per lamp is approximately 2900 lumens. As shown, five separate graph traces are depicted, and defined within the key 602. The traces represent viewing positions with respect to the fixture that range between a position approximately aligned with the elongated axis 359 (0 degrees, or aside one of the narrow ends of the fixture 300) and a position perpendicular to the elongated axis (90 degrees along axis 520—or aside the long exposed sides of the fixture). Thus, the trace 610 represents the sensed candela level at 0 degrees, the trace 620 is at 22.5 degrees, the trace 630 is at 45 degrees, the trace 640 is at 67.5 degrees, and the trace 650 is at 90 degrees (directly sideward). The candela output ranges from approximately 0 lumens (sensed for all traces at 180 degrees, where the sensor is directly over the opaque top of the housing 310), to a maximum of approximately 1410 lumens for the 90-degree trace 650 at 45 degrees about the elongated axis 359. In general, the light output is strongest at all viewing angles when viewed directly aside the fixture, and weakest when viewed along the end of the fixture. Within each trace, the light output remains relatively strong and uniform and from slightly above 90 degrees (up to about 120 degrees) to directly below the fixture (0 degrees). Thus output is efficiently spread out in all directions from the lamp with the greatest output generally between about 70 degrees and 25 degrees—and is as much as 300 lumens greater than sensed at other viewing angles. This ensures that much of the light is directed sideward, to more completely fill the lighted space.

Before describing a further illustrative embodiment of the invention below reference is made again to FIG. 5 in which a decorative or trademark-displaying device 560 is applied to the bottom side of the transparent/translucent cover 330. A unitary stem 564 of the device 560 is inserted into an aperture 562 on the bottom side of the cover 330. It is held in place by a snap-fit and/or adhesives. Its exposed portion can define any acceptable outline shape, such a circle. The device 560 can be translucent, and provided in one or more distinctive colors, at least some of which are dissimilar from the surrounding cover's shade or tone. In this manner, the cover 330 projects a distinctive, colored glowing device along its surface that attracts the viewer to the cover, but has a negligible effect on overall light transmission from the fixture. In various embodiments, such a novel device can be applied along any location on any of the fixture covers described herein.

Figure 7:
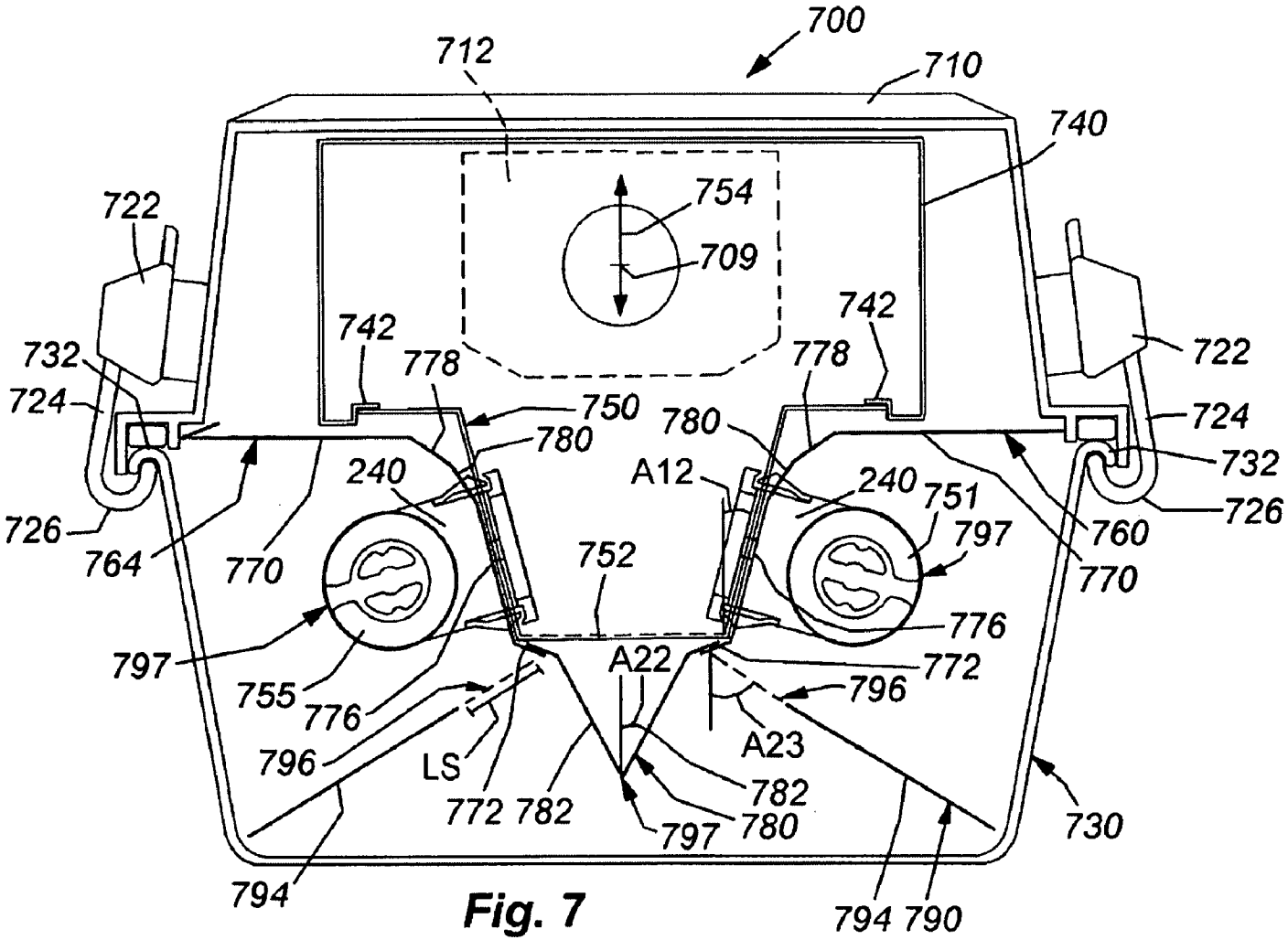
FIG. 7 is a side cross section of a two-lamp lighting fixture for use in garages and other weather-exposed environments according to an illustrative embodiment of this invention.
Figure 8:
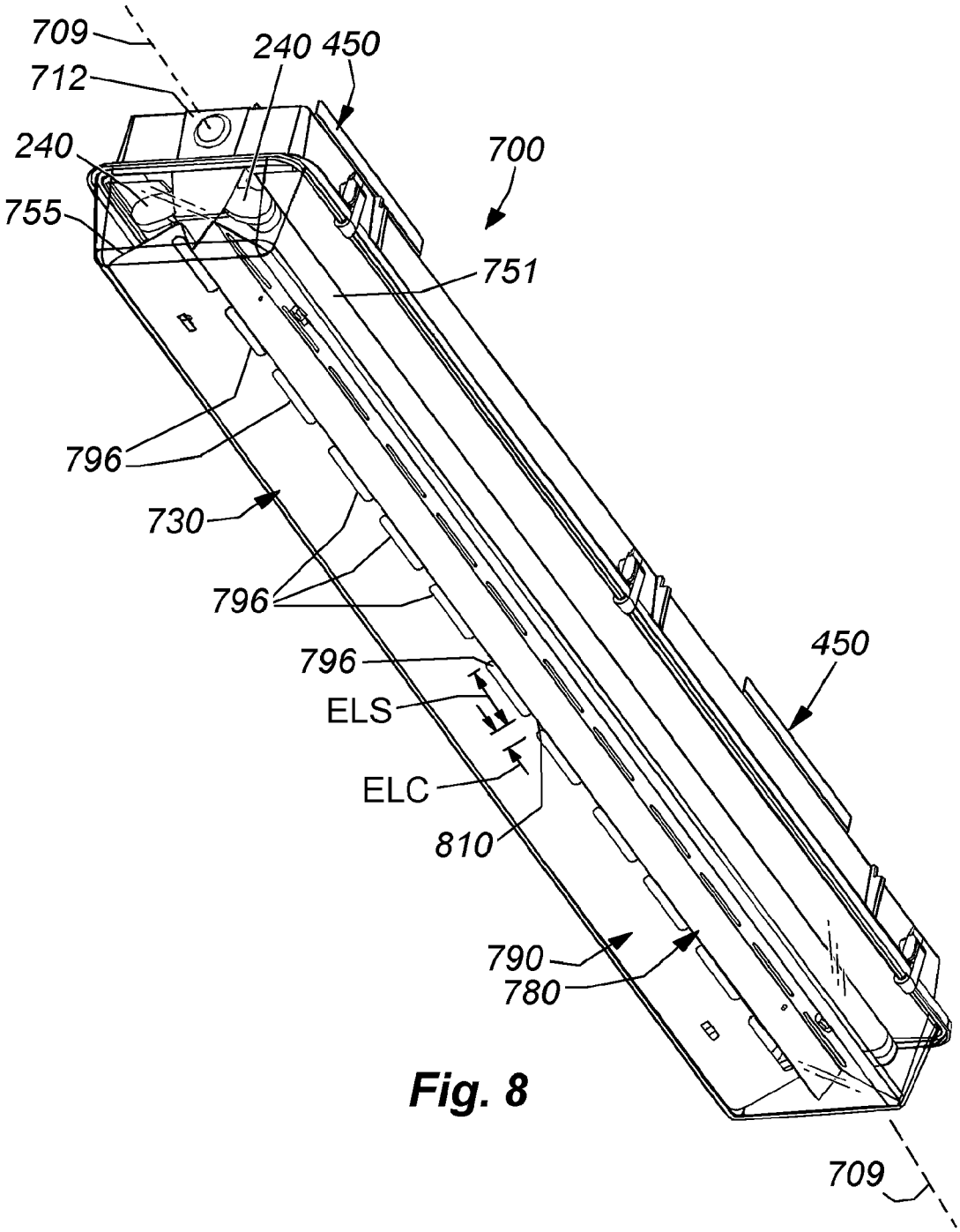
FIG. 8 is a perspective view of the two-lamp fixture of FIG. 7.
Figure 9:
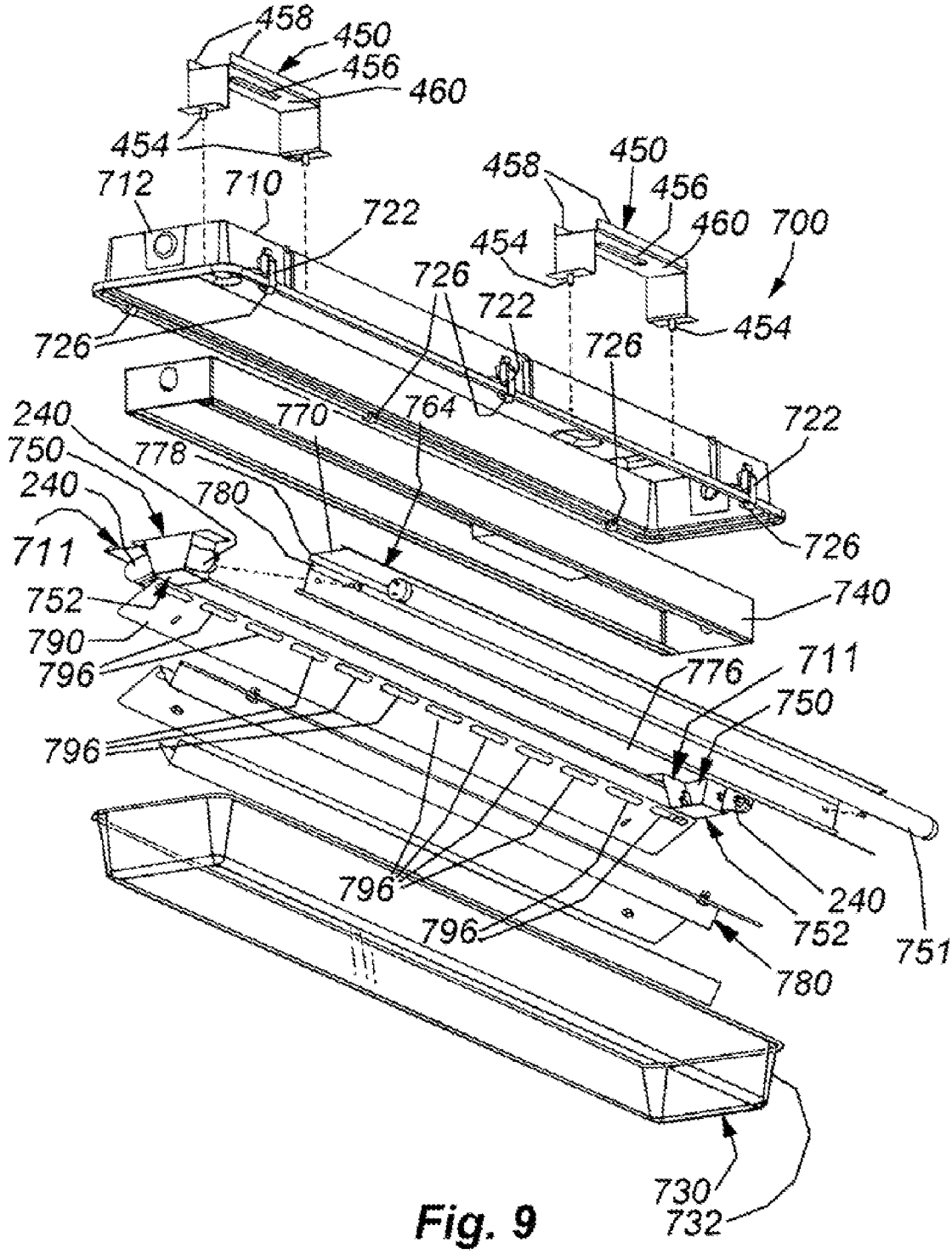
FIG. 9 is an exploded perspective view of the two-lamp fixture of FIG. 7.

FIGS. 7-9 detail a two-lamp fixture 700 according to an illustrative embodiment invention. In this embodiment, a housing 710 similar in size, shape and construction/materials to the housings 210, 310 described above, is provided. In general, the fixture housing 710 also includes bases 722 for spring clips 724 that include rounded-over end segments 726 for engaging a lip 732 formed on the perimeter of a transparent/translucent cover 730, also similar to those described above. The ballast 712 is again mounted within the upper portion of the housing, within a sheet metal (or other material) box structure 740.

The bottom edge 742 of the box structure 740 supports a pair of longitudinally opposed lamp supports 711 (FIG. 9), each defining a central base 750 that extends further downwardly, and divides the fixture's lower end into three separate sections, two of which (the opposing sideward sections contain lamp holders 240. In particular each support 711 is attached to an opposing end of the box 740, along the bottom edge 742. The separate lamp sections defined by each central base 750 provide support for reflectors that extend along the entire longitudinal direction, taken along elongated axis 709. In this embodiment, the lamp holders 240 are mounted along a steeply downwardly angled base sections on each side that extend at an angle A12 between approximately 5 degrees and 20 degrees. The illustrative angle A12 is approximately 15 degrees in this embodiment.

The central base 750 supports a pair of side reflectors 760, 764 having upper flats 770 that are essentially perpendicular with respect to the vertical (arrow 754). The side reflectors 760, 764 each define a pair of upper intermediate flats 780 and 778 that join to a central flat 776. The central flat 776 is flush against the side walls of the central base 750. As in the above-described fixture 300, the side reflectors 760 and 764 direct the light of their respective lamps 751, 755 into a somewhat downward, but generally sideways-reflected orientation. The bottom side 752 of the central base 750 is relatively flat. The bottom edges 772 of each side reflector 760, 764 wrap inwardly to surround the bottom section. A central divider reflector 780 extends downwardly from the flat central base section 752. More particularly, a pair of downwardly extending reflector walls 782 each define a cross section extending from spaced-apart locations at their adjacent lower reflector portions 794, adjacent to edges of the below-described slots 796, to a bottommost convergence peak/line 797. In this divider reflector 780, each wall 782 defines an opposing angle A22 of between approximately 24 and 34 degrees with respect to the vertical 754. The illustrative angle A22 is approximately 29 degrees. The bottom edges 772 of the side reflectors and central reflector 780 merge with a wide-angle lower reflector 790. The lower reflector 790 includes opposing angled flats 794. These flats 794 extend in opposing, generally widthwise directions at an angle A23 with respect to vertical 754. In this embodiment, the angle A23 is between approximately fifty degrees and seventy degrees with an illustrative angle of sixty degrees. The combination of slots 796 and the central reflector 780 advantageously generate the image of a center light source from the projected light of the two side light sources 751, 755. Thus, the overall appearance of the fixture 700 is balanced, creating the illusion of a three-lamp fixture with a "virtual" center light source.

Notably, the lower reflector 790 includes, adjacent to the central reflector 780, a series of spaced-apart elongated slots 796. The slots are better viewed, extending along the elongate/longitudinal axis 709, in FIGS. 8 and 9. The slots 796 each have a widthwise length LS (FIG. 7) of between approximately ½ inch and one inch. They have an elongated length ELS (FIG. 8) of between approximately two inches and four inches. They are separated by smaller, unbroken segments 810 (FIG. 8) along the elongated length having a length ELC between approximately ½ inch and two inches. The dimensions of the slots and the connecting segments are highly variable in alternate embodiments. In general, it is desirable to make the slots extend as long as possible along the length of the reflector 790, without compromising the strength of the reflector by overly-shortening the connecting segments. In other words, the length of the connecting segments 810 should be minimized, while maintaining the structural integrity of the reflector assembly. In alternate embodiments, the term "slot" should be taken broadly to include a continuous opening in the reflector through which light from the sides can pass in predetermined quantities into the lower section. In such cases, the reflector (790) would be maintained in its position by alternate bracket mechanisms.

In this embodiment, the upper surface of each flat 794 also acts as the lower reflector flat for each side reflector 760, 764. Thus, the amount of material used in the reflectors can be further minimized, while not compromising the integrity of the overall structure. Any or all reflectors can be coated on a lamp-facing side with an appropriate reflective and/or specular finish. The depicted reflectors 760, 764, 780 and 790 can be variably attached to the central supports 750, 752 by fasteners, or another acceptable attachment mechanism. In accordance with this embodiment, the lamps 751 and 755, which are standard 48-inch, bi-pin, T-8 fluorescent lamps with 2900-lumen average output, provide ample side-lighting through their encapsulation by the side reflectors 760 and 764. As discussed above, the upper flats 770 and lower flats 794 extend at least one to two inches in a widthwise direction beyond the far ends 797 of the lamps, and nearly contact the inside surface of the cover 730. By locating the reflector slots 796, adjacent to the central reflector 780, combined with the angles of the central reflector, light transmitted through the slots 796 from the lamps 751, 755 is projected downwardly in sufficient quantity to light the area directly below, and slightly aside the fixture 700. Thus, the fixture 700 provides desired side-lighting along with a sufficient quantity of direct-downward lighting using only two light sources, located within the area of each respective side reflector 760, 764.

The fixture 700 can be supplied with mounting brackets 450 similar to those described above with reference to the fixture 300 (see FIGS. 8 and 9). Any of the fixtures described herein can be provided with alternate brackets as appropriate to the particular mounting application.

Figure 10:
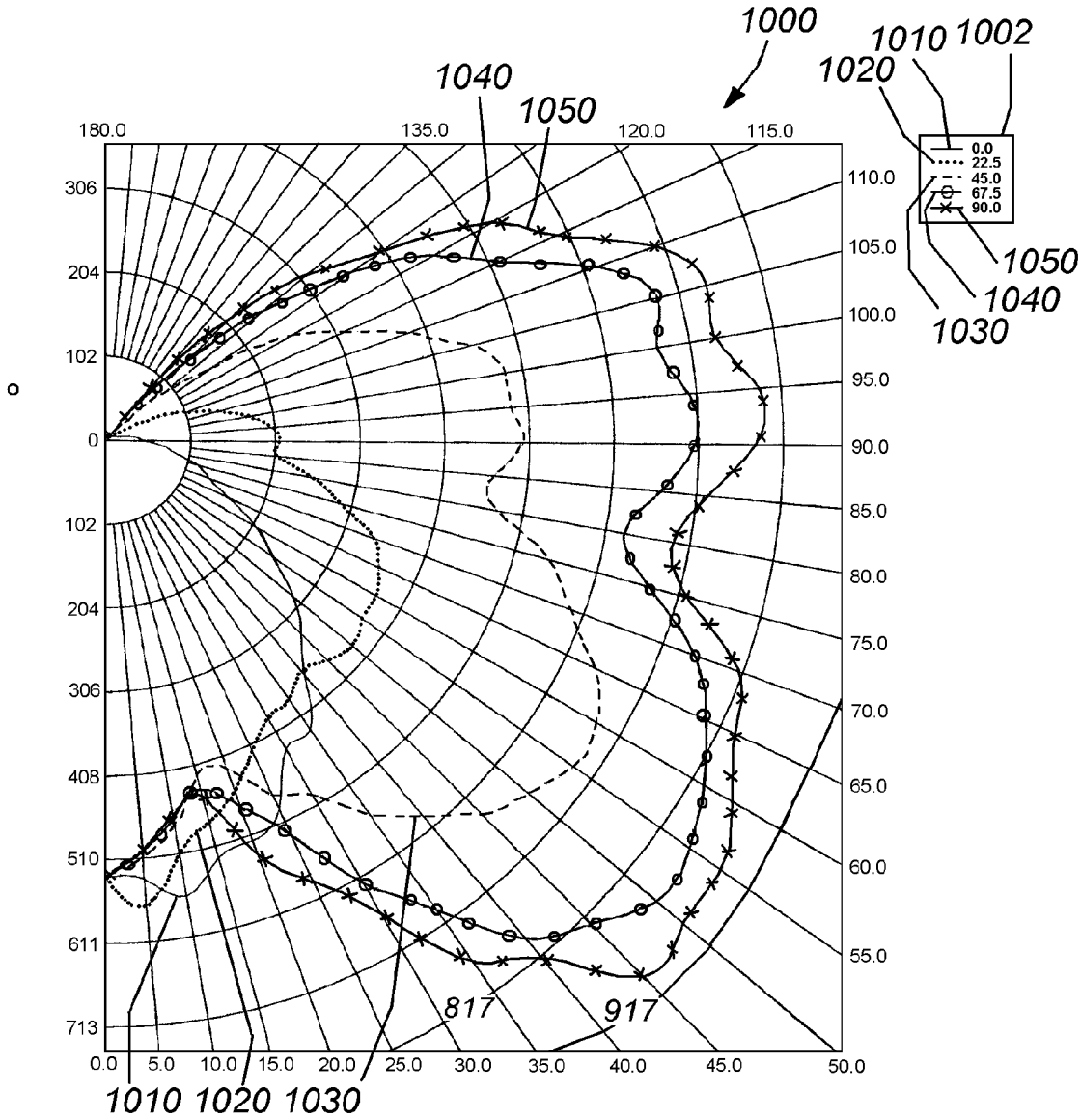
FIG. 10 is a is a polar-coordinate graph of the light distribution at various viewing angles for two-lamp fixture of FIG. 7.

The candela performance of the fixture 700 is shown in the polar-coordinate graph 1000 of FIG. 10. Overall, the maximum light output (in lumens) is reduced from a maximum of approximately 1400 lumens to a maximum of approximately 900 lumens relative to the three-lamp fixture 300 described in the graph 600 of FIG. 6. In this graph 1000, the traces are listed in the key 1002. Similar to the graph 600 in FIG. 6, the traces represent the sensed light output from directly beneath (0 degrees), to directly aside (90 degrees), to directly above (180 degrees) the fixture 700. Each trace discretely represents a viewing position. Trace 1010 is directly toward the fixture's narrow end, in line with the axis 709 (0 degrees). Trace 1050 is directly aside the elongated side of the fixture 700 (90 degrees). Trace 1030 is at a 45-degree angle. Trace 1020 is at a 22.5-degree angle and trace 1040 is at a 67.5-degree angle. As shown, relatively sideward viewing produces sensed light output that remains in the 700 to 900-lumen range from about 110 degrees (a position above the top reflector flats (770) plane), to about 30 degrees. Output for all traces falls rapidly to zero as the angle approaches 180 degrees, directly above the housing. Output for all traces remains relatively high at over 500 lumens as the angle approaches zero degrees (directly below the fixture). Thus, the two-lamp fixture exhibits a good quantity of side-lighting performance (above approximately 30-45 degrees to the vertical), where some extra output is needed to completely fill the space, while maintaining a strong, but controlled light output in the "generally downward" direction (below approximately 30-45 degrees to the vertical). To vary the amount of directly downward light output, the width of the slots can be increased until the desired balance is achieved between downward and side lighting. Additionally, where side, lighting in a plurality of directions is desired, mounting of fixtures in the space so that some face at 90 degrees with respect to the others (e.g. mounting the fixtures so that the elongated axes 359, 709 on some fixtures perpendicular to the axes 359, 709 of others) will more effectively light the entire area.

Figure 11:
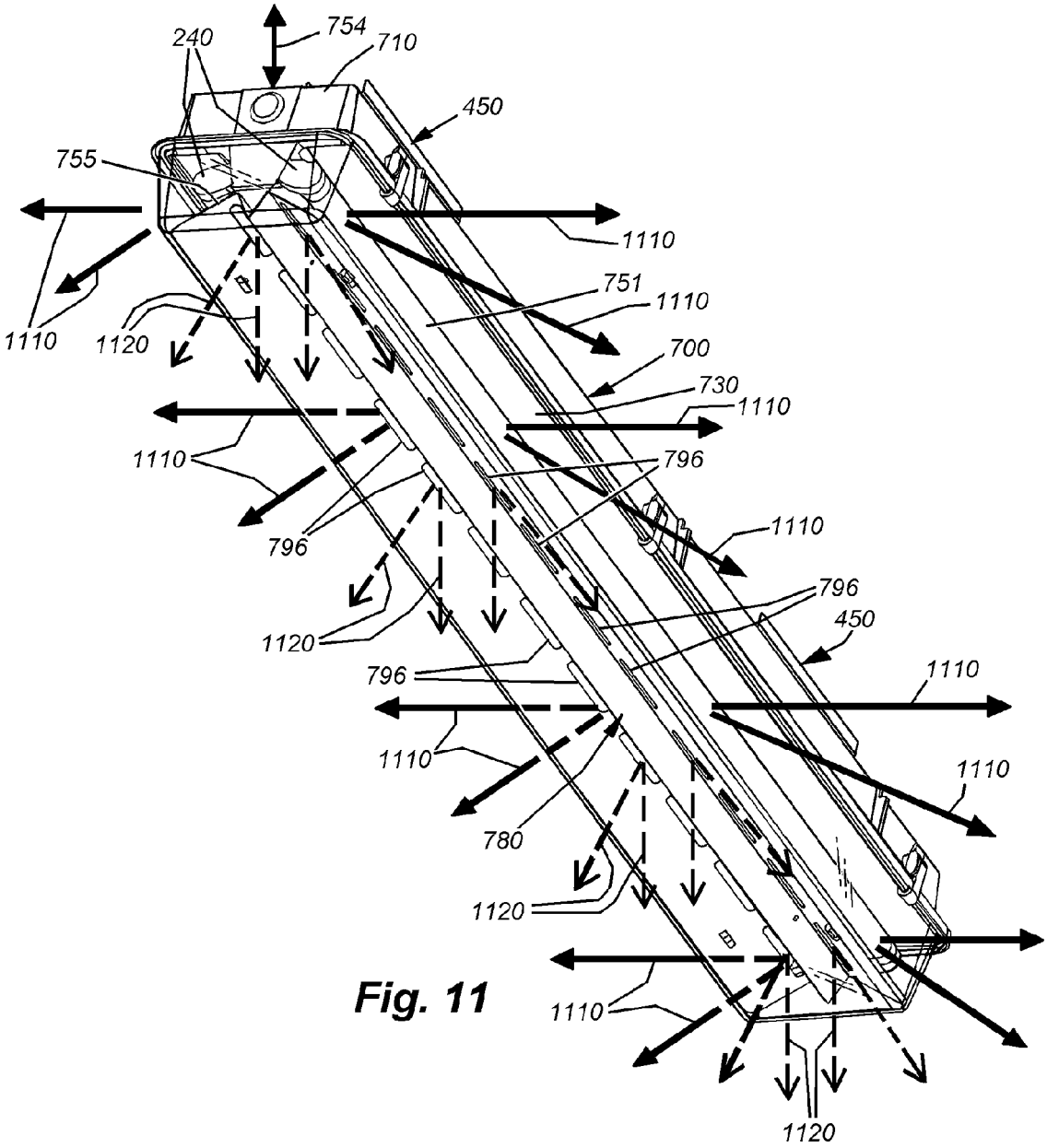
FIG. 11 is a perspective view of the two-lamp fixture of FIG. 7 showing the projection of light therefrom in each of a plurality of desired directions.

Shown more graphically, FIG. 11 details the lighting pattern of the illustrative two-lamp fixture 700. In general, a significant portion of light (thicker solid arrows 1110) directed in a sideways manner. A reduced, but still desirable quantity of downward light (dashed arrows 1120) is transmitted over a predetermined range of angles with respect to the vertical 754.

Figure 12:
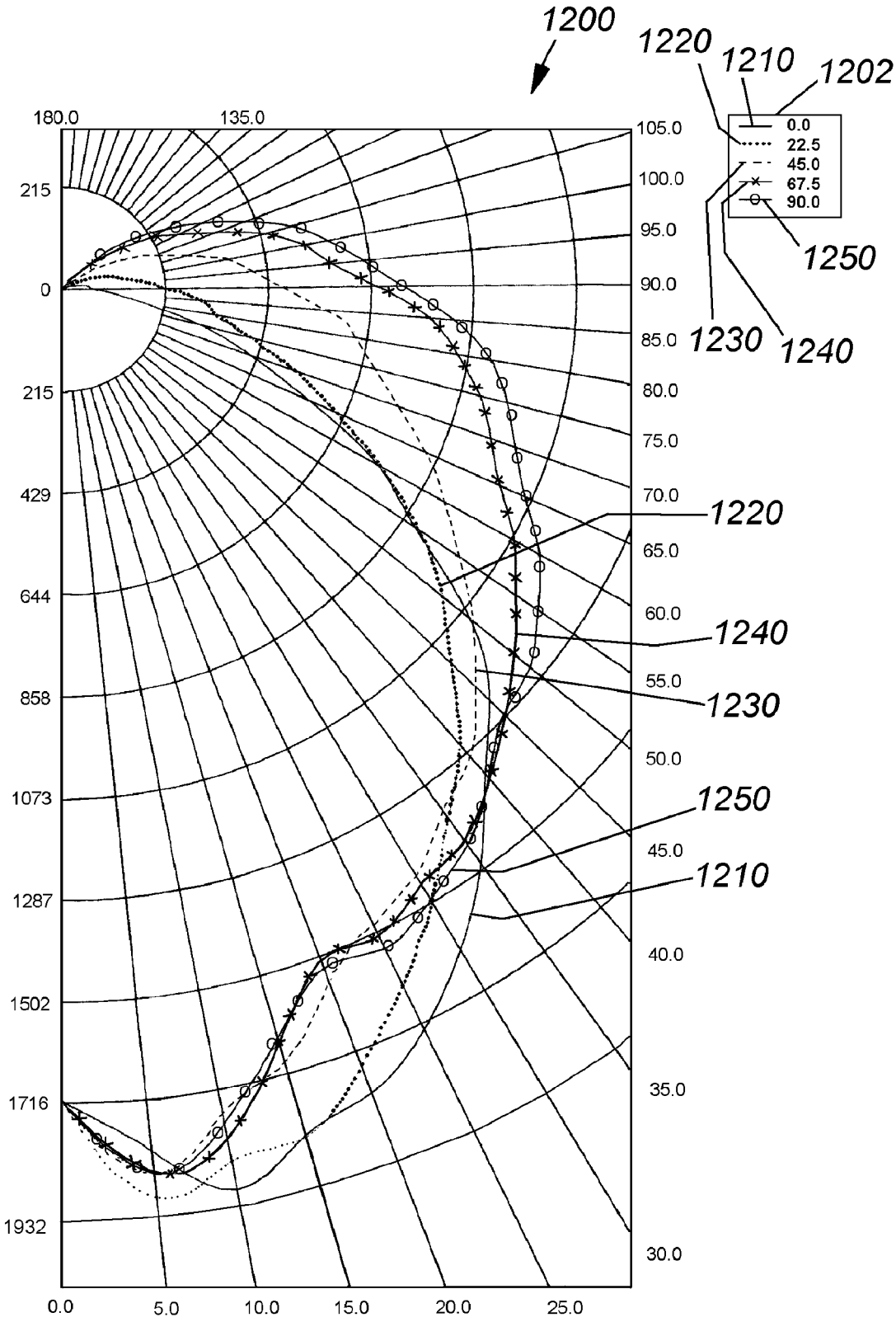
FIG. 12 is a polar-coordinate graph of the light distribution at various viewing angles for the three-lamp fixture of the prior implementation of FIG. 2, shown for comparison.

By way of comparison, the candela distribution in lumens for the prior implementation of a three-lamp fixture 200 as shown in FIG. 2 is shown in the polar-coordinate graph 1200 in FIG. 12. As discussed above, this prior implementation provides no encapsulation of the side lamps 251 and 255 by separate side reflectors. Thus a large quantity of light is projected downwardly. This creates the undesirable spotting of light below the fixture as revealed by the graph 1200. Again, the traces, 1210, 1220, 1230, 1240, and 1250, representing viewing angles from 0 (viewed on end) to 90 degrees (viewed directly aside), are defined in the graph key 1202. All traces show significant output, in the generally downward direction, rising continuously from approximately 1000 lumens at 65 degrees to over 1900 lumens at 5 degrees. Output falls rapidly 65 degrees. Hence very little side output or upwardly angled output is provided by the fixture 200. Unlike novel fixtures 300, 700, the prior fixture 200 does not provide the needed side lighting for a low-ceiling space, such as a parking garage.

The foregoing has been a detailed description of illustrative embodiments of the invention. Various modifications and additions can be made without departing from the spirit and scope if this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, For example, the size and shape of the housing can be varied to accommodate different shapes and sized of elongated lighting sources. As described, the light source itself (also referred to as a lamp) can be highly variable. Such light sources can project outwardly, or at a variety of angles (for example, an LED array formed in a semi-ellipsoid or semi-cylinder). As such the depiction of fluorescent lamps herein should be interpreted broadly to include other types of lighting arrangements, such as an LED array (e.g. a type of solid state lighting array). Moreover, while a single large-diameter tubular fluorescent lamp is employed in each mounting location, it expressly contemplated that a single lamp can be substituted with a plurality of discrete smaller diameter lamps, or a continuous lamp with two or more legs, having a 180-degree bend on one end. The terms "lamp" and "light source" should be taken broadly to include such multi-leg and multi-lamp configurations, as well. The mechanism by which the transparent/translucent cover is secured to the upper housing can be varied as well. Instead of clips, alternate embodiments can employ (for example) threaded fasteners, sliding components or other mechanisms to sealingly engage the cover with the housing. In addition, the mechanisms by which reflectors and lamp holders are attached to the housing are highly variable. A variety of different bracket systems that secure reflectors and lamp holders to the housing can be employed. In addition, the housing or other structures can be reinforced with further stiffening ribs, brackets, braces or other structures. Moreover, while the novel fixtures provided herein are useful in parking garages and other low-ceiling or low-fixture-mounting-height spaces, it is contemplated that the principles lamp placement and reflector construction/orientation described herein can be employed in a variety of lighting applications, including those in which the fixtures are mounted higher with respect to a ground surface. Accordingly, this description is meant to be taken only by way of example, and not to otherwise limit the scope of this invention.

What is claimed is:

1. A lighting fixture comprising;

a housing having a widthwise dimension and an elongated dimension adapted to be mounted to a supporting structure;

a light-transmitting cover secured to a lower end of the housing with a seal provided between the housing and the cover;

a light source supporting structure operatively connected to the housing and securing a first light source and a second light source so that the first light source and the second light source each extend along the elongated dimension on each of opposing widthwise sides of the housing;

a reflector assembly with a cross section shape constructed and arranged to cover each of the first light source and the second light source with upper reflector portions, lower reflector portions and central reflector portions, the upper reflector portions and lower reflector portions respectively extending in a generally widthwise direction so as to fully overlie and extend beyond a widthwise end of each of the first light source and the second light source so that the predetermined light output from each of the first light source and the second light source is directed above a generally downward direction, and the lower reflector portions defining at least part of a central lower reflector constructed and arranged to allow predetermined light output to be discretely projected in the generally downward direction;

wherein the central lower reflector encloses a third lighting source, extending in the elongated dimension, that projects light discretely in the generally downward direction; and wherein each of the lower reflector portions extend at a downward angle of between approximately 110 and 130 degrees with respect to a vertical dimension taken in an upward to downward direction.

2. The lighting fixture as set forth in claim 1 wherein the central reflector portions extend upwardly at an angle of between approximately 5 and 20 degrees with respect to the vertical dimension.

3. The lighting fixture as set forth in claim 2 wherein at least one of the first light source, the second light source and the third light source comprises a tubular fluorescent lamp.

4. The lighting fixture as set forth in claim 2 wherein at least one of the first light source, the second light source and the third light source comprises a solid state lighting array.

5. The lighting fixture as set forth in claim 1 wherein the housing is approximately 47-48 inches in the elongated dimension and approximately 6-7 inches in the widthwise dimension.

6. A lighting fixture comprising:

a housing having a widthwise dimension and an elongated dimension adapted to be mounted to a supporting structure;

a light-transmitting cover secured to a lower end of the housing with a seal provided between the housing and the cover;

a light source supporting structure operatively connected to the housing and securing a first light source and a second light source so that the first light source and the second light source each extend along the elongated dimension on each of opposing widthwise sides of the housing;

a reflector assembly with a cross section shape constructed and arranged to cover each of the first light source and the second light source with upper reflector portions, lower reflector portions and central reflector portions, the upper reflector portions and lower reflector portions respectively extending in a generally widthwise direction so as to fully overlie and extend beyond a widthwise end of each of the first light source and the second light source so that the predetermined light output from each of the first light source and the second light source is directed above a generally downward direction, and the lower reflector portions defining at least part of a central lower reflector constructed and arranged to allow predetermined light output to be discretely projected in the generally downward direction; and wherein the central lower reflector includes a plurality of elongated slots therealong that respectively transmit light from the first light source and the second light source into a region of the central lower reflector so that the light transmitted through the slots is directed in the generally downward direction.

7. The lighting fixture as set forth in claim 6 wherein each of the lower reflector portions extend at a downward angle of between approximately 50 and 70 degrees with respect to a vertical dimension taken in an upward to downward direction.

8. The lighting fixture as set forth in claim 7 wherein the central reflector portions extend upwardly at an angle of between approximately 5 and 20 degrees with respect to the vertical dimension.

9. The lighting fixture as set forth in claim 8 further comprising a central divider reflector with a pair of downwardly extending reflector walls defining a cross section extending from spaced-apart locations at the lower reflector portions, adjacent to edges of the slots, to a bottommost convergence line.

10. The lighting fixture as set forth in claim 9 wherein each of the reflector walls of the central divider reflector extend upwardly from the convergence line at an angle of between approximately 24 and 34 degrees with respect to the vertical dimension.

11. The lighting fixture as set forth in claim 6 wherein the slots have a length generally along the widthwise dimension of between approximately ½ and 1 inch.

12. The lighting fixture as set forth in claim 6 wherein at least one of the first light source and the second light source comprises a tubular fluorescent lamp.

13. The lighting fixture as set forth in claim 6 wherein at least one of the first light source and the second light source comprises a solid state lighting array.

14. A lighting fixture comprising:

a housing having a widthwise dimension and an elongated dimension adapted to be mounted to a supporting structure;

a light-transmitting cover secured to a lower end of the housing with a seal provided between the housing and the cover;

a light source supporting structure operatively connected to the housing and securing a first light source and a second light source so that the first light source and the second light source each extend along the elongated dimension on each of opposing widthwise sides of the housing;

a reflector assembly with a cross section shape constructed and arranged to cover each of the first light source and the second light source with upper reflector portions, lower reflector portions and central reflector portions, the upper reflector portions and lower reflector portions respectively extending in a generally widthwise direction so as to fully overlie and extend beyond a widthwise end of each of the first light source and the second light source so that the predetermined light output from each of the first light source and the second light source is directed above a generally downward direction, and the lower reflector portions defining at least a part of a central lower reflector constructed and arranged to allow predetermined light output to be discretely projected in the generally downward direction; and a pair of brackets adapted to attach to a post extending vertically from a supporting surface located above the housing, each of the pair of brackets defining a pair of spaced-apart, generally horizontal bases attached to the housing by fasteners and connected to an upwardly positioned horizontal bracket plate, the plate having an elongated slot for receiving the post therethrough.

15. The lighting fixture as set forth in claim 14 wherein the horizontal plate includes folded-up wings to reinforce the horizontal bracket plate.

16. The lighting fixture as set forth in claim 14 wherein at least one of the first light source and the second light source comprises a solid state lighting array.

17. The lighting fixture as set forth in claim 14 wherein the central lower reflector includes a plurality of elongated slots therealong that respectively transmit light from the first light source and the second light source into a region of the central lower reflector so that the light transmitted through the slots is directed in the generally downward direction.

18. The lighting fixture as set forth in claim 17 further comprising a central divider reflector with a pair of downwardly extending reflector walls defining a cross section extending from spaced-apart locations at the lower reflector portions, adjacent to edges of the slots, to a bottommost convergence line.

19. The lighting fixture as set forth in claim 14 wherein the central lower reflector encloses a third lighting source, extending in the elongated dimension, that projects light discretely in the generally downward direction.

20. The lighting fixture as set forth in claim 14 wherein each of the lower reflector portions extend at a downward angle of between approximately 110 and 130 degrees with respect to a vertical dimension taken in an upward to downward direction.

* * * * *